US010213089B2

(12) United States Patent
Gerold

(10) Patent No.: US 10,213,089 B2
(45) Date of Patent: Feb. 26, 2019

(54) WASHING AGENT DISPENSER FOR A WASHING MACHINE, IN PARTICULAR A DISHWASHER

(71) Applicant: ELBI INTERNATIONAL S.p.A., Turin (IT)

(72) Inventor: Jans Gerold, Waldburg (DE)

(73) Assignee: ELBI INTERNATIONAL S.P.A., Turin (IT)

( * ) Notice: Subject to any disclaimer, the term of this patent is extended or adjusted under 35 U.S.C. 154(b) by 0 days.

(21) Appl. No.: 15/823,788

(22) Filed: Nov. 28, 2017

(65) Prior Publication Data

US 2018/0153371 A1 Jun. 7, 2018

(30) Foreign Application Priority Data

Dec. 1, 2016 (IT) ..... 102016121779

(51) Int. Cl.
*A47L 15/44* (2006.01)

(52) U.S. Cl.
CPC ..... *A47L 15/4409* (2013.01)

(58) Field of Classification Search
CPC .. A47L 15/44; A47L 15/4409; A47L 15/4418; A47L 15/4436; D06F 39/02; D06F 39/022
See application file for complete search history.

(56) References Cited

U.S. PATENT DOCUMENTS 5,133,487 A * 7/1992 Russi ..... A47L 15/4409 134/93
5,603,431 A * 2/1997 Tuller ..... A47L 15/4409 134/58 D
(Continued)

FOREIGN PATENT DOCUMENTS

| | | | |
|---|---|---|---|
| CN | 204207701 | U | 3/2015 |
| KR | 10-0892672 | B1 | 4/2009 |
| WO | 2007/116354 | A2 | 10/2007 |

(Continued)

OTHER PUBLICATIONS

Italian Search Report for IT201600121779 dated Jun. 27, 2017.
Form IT 237 for IT201600121779 dated Jun. 27, 2008.

*Primary Examiner* — David G Cormier
(74) *Attorney, Agent, or Firm* — Sughrue Mion, PLLC

(57) ABSTRACT

A washing agent dispenser for a dishwasher, including a casing defining at least a receptacle adapted to receive an amount of washing agent; a cover displaceable relative to the casing between an opening position and a closing position of the receptacle; the cover carrying an elastic gasket, adapted to sealingly close said receptacle in the closing position of the cover; and a retaining mechanism having a retaining member movable in the casing, and a hooking member movable in the cover and adapted to cooperate with the retaining member. When the cover closes the receptacle the hooking member is kept, by an associated resilient member carried by the cover, in a condition of engagement with the retaining member, maintaining the cover in the closing position. The resilient member associated with the hooking member comprises an appendage integrally formed with and extending from the elastic sealing gasket and interposed between the cover and the hooking member.

1 Claim, 6 Drawing Sheets

(56) References Cited

U.S. PATENT DOCUMENTS

| | | | | |
|---|---|---|---|---|
| 2005/0039778 | A1* | 2/2005 | Cantave | A47L 15/4409 134/25.2 |
| 2007/0215653 | A1* | 9/2007 | Marone | A47L 15/4409 222/651 |

FOREIGN PATENT DOCUMENTS

| | | | |
|---|---|---|---|
| WO | 2011/067724 | A2 | 6/2011 |
| WO | 2012/117090 | A1 | 9/2012 |
| WO | 2015/001511 | A1 | 1/2015 |

* cited by examiner

WASHING AGENT DISPENSER FOR A WASHING MACHINE, IN PARTICULAR A DISHWASHER

BACKGROUND OF THE INVENTION

Field of the Invention

The present invention relates to the dispensing of a washing agent in a household washing machine, particularly a dishwasher.

More specifically, the invention relates to a washing agent dispenser of the kind comprising

- a casing defining at least a receptacle adapted to receive an amount of washing agent,
- a cover displaceable relative to the casing between an opening position and a closing position, in which it opens and closes said receptacle, respectively; the cover carrying a gasket made of an elastic material, adapted to sealingly close said receptacle in said closing position of the cover; and
- a retaining mechanism including
- a retaining member movably mounted in the casing, and
- a hooking member movably mounted in the cover and adapted to cooperate with the retaining member such that
- when the cover closes the receptacle the hooking member is kept by an associated resilient member carried by the cover in a condition of engagement with the retaining member, maintaining the cover in the closing position;
- said hooking member being disengageable from the retaining member, either manually or by means of an actuator associated with said retaining member.

BACKGROUND

In a washing agent dispenser of this kind the hooking member is a lever pivotably mounted in the cover, and the associated resilient member is a helical spring, likewise carried by the cover and interposed between a wall portion of the cover and one arm of said lever.

Such a solution is complicate in structure and expensive to manufacture and assemble.

One object of the present invention is to propose an improved washing agent dispenser of the initially defined kind.

SUMMARY OF THE INVENTION

This and other objects are achieved according to the invention by a washing agent dispenser of the initially defined kind, characterized in that the resilient member associated with the hooking member carried by the cover comprises an appendage integrally formed with and extending from said elastic sealing gasket, said appendage of the gasket being interposed between the cover and said hooking member.

Thanks to the above features, in a washing agent dispenser according to the present invention the number of components is reduced, and the assembly thereof is simplified and less expensive.

BRIEF DESCRIPTION OF THE DRAWINGS

Further features and advantages of the present invention will become apparent from the following detailed description, provided by way of non-limiting example, with reference to the attached drawings, wherein.

DETAILED DESCRIPTION OF THE INVENTION

Figure 1:
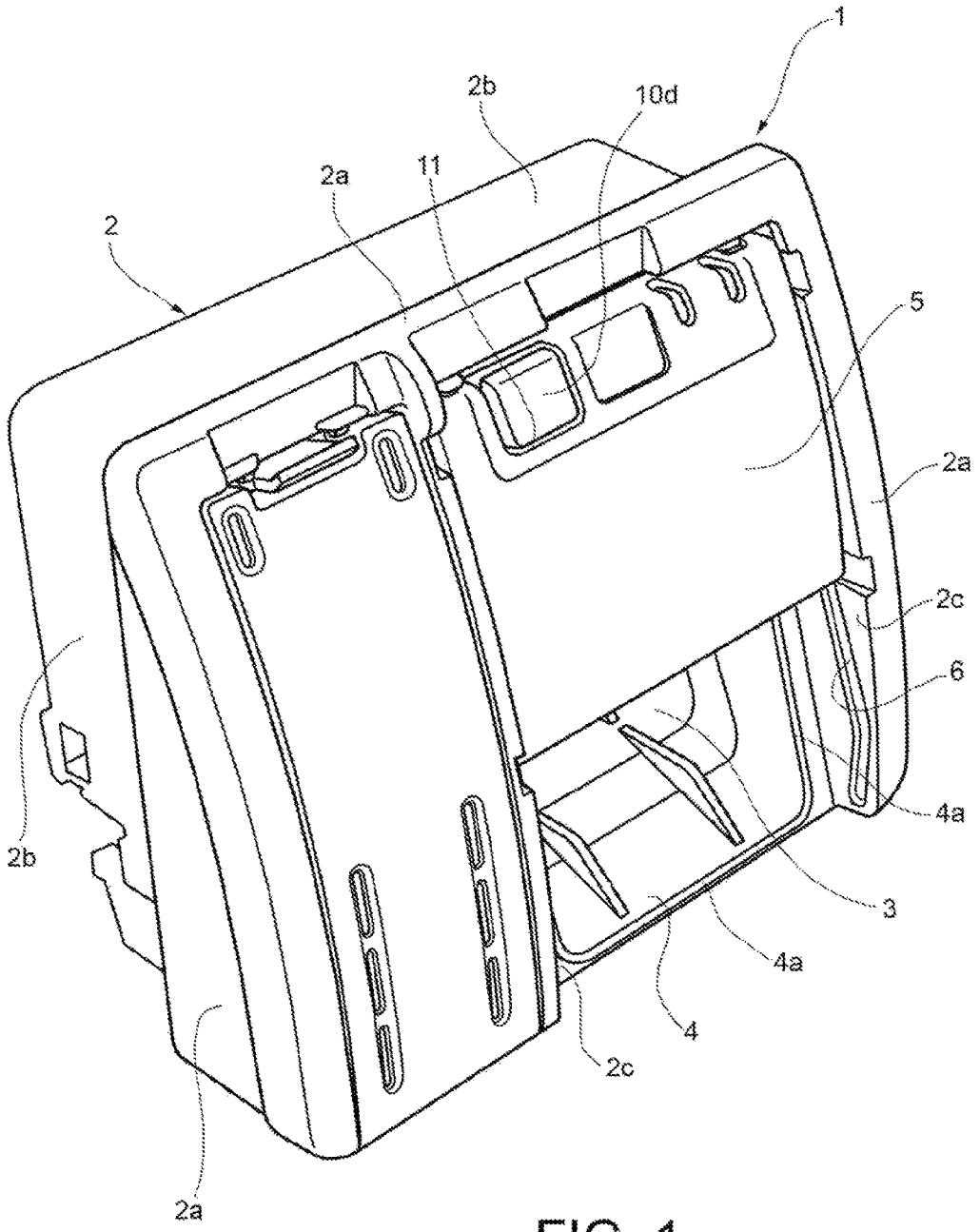
FIG. 1 is a perspective view of a washing agent dispenser according to the present invention, shown in the open condition.
Figure 2:
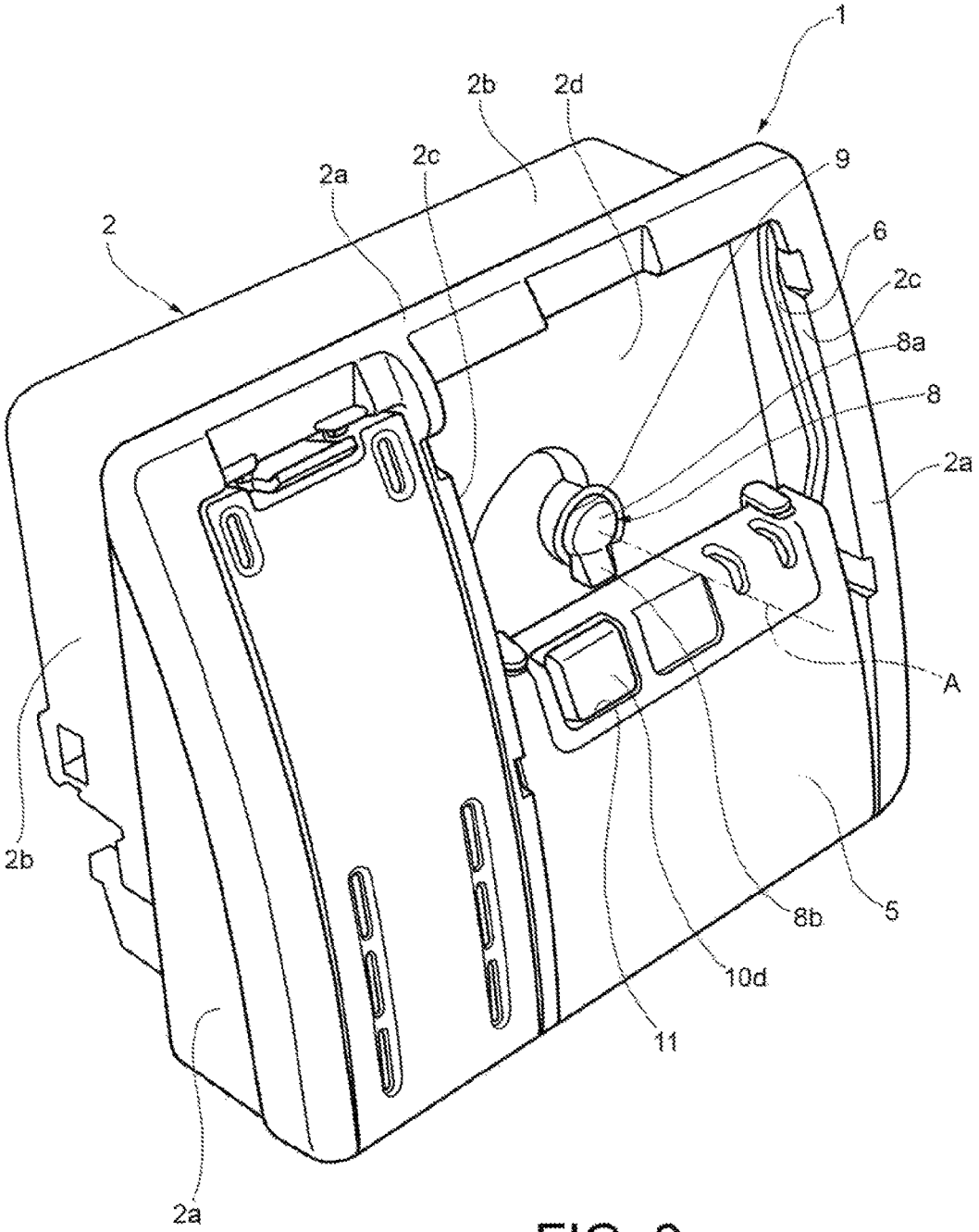
FIG. 2 is a perspective view of the dispenser according to FIG. 1, shown in the closed condition.

In FIGS. 1 and 2 the general reference number 1 indicates a dispenser according to the present invention, for dispensing a washing agent, such as a solid, liquid or powder deter-gent, in a washing machine, in particular a dishwasher.

The dispenser 1 comprises a body or casing 2, made for instance of moulded plastic, which is operationally fixed. The body or casing 2 is designed to be secured (in a per se known manner) to an inside surface of the front door of a dishwasher, for example.

The body or casing 2 can be formed of two portions, namely a front portion 2*a* and a rear portion 2*b*, made for instance of different plastic materials, joined to one another for instance by thermal welding.

In the front portion 2*a* of the casing 2 there is defined a hollow receptacle 3 (FIGS. 1 and 3) intended to receive an amount of a washing agent.

The receptacle 3 has a mouth 4, with a raised contour edge 4*a*.

The dispenser comprises further a cover 5, which is mounted slidable between two confronting walls 2*c* of the casing 2.

Figure 4:
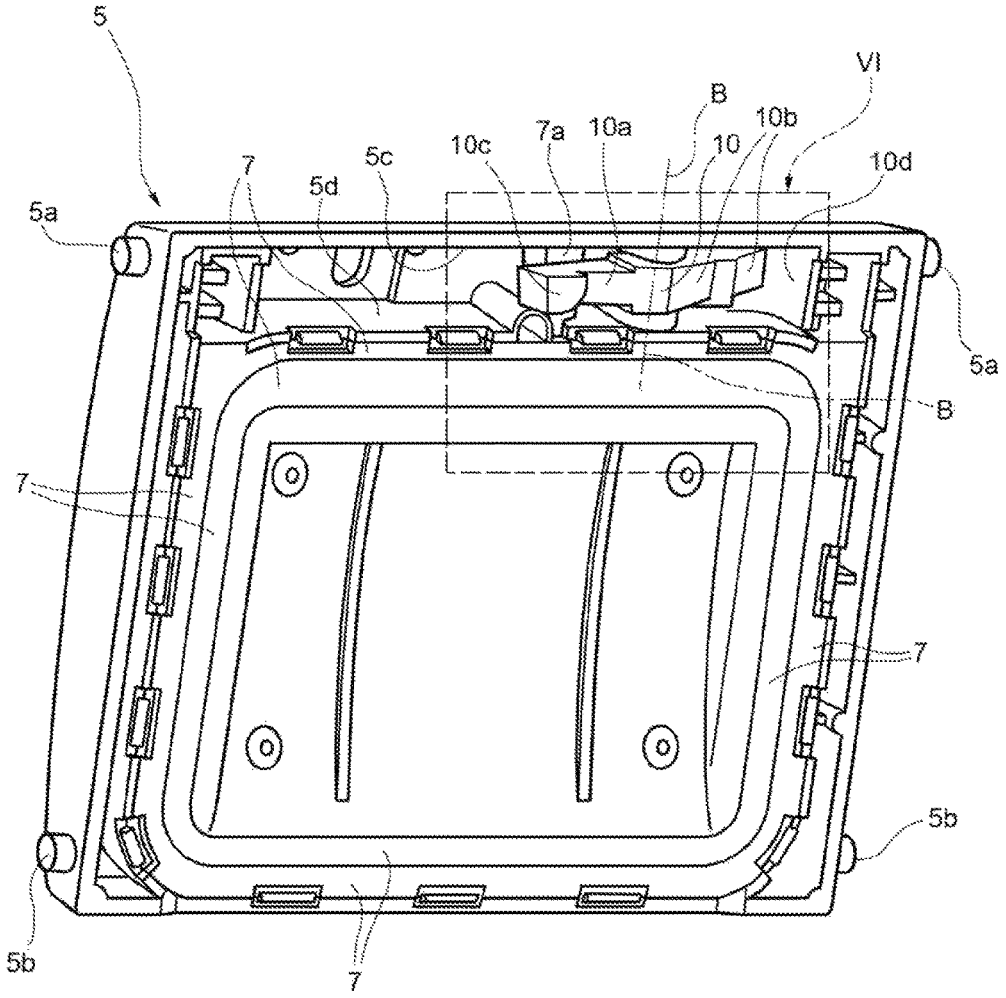
FIG. 4 is a rear perspective view, showing the internal side of the cover of the dispenser according the preceding figures.

As it can be seen in FIG. 4, on each of two opposite sides the cover 5 is provided with a respective pair of protruding pins 5*a*, 5*b*, which are mounted slidable in guide grooves 6 predisposed in each of the confronting walls 2*c* of the casing 2.

Through the engagement of the projecting pins 5*a*, 5*b* in the guiding grooves 6, the cover 5 is slidable relative to the casing 2, between an opening position (shown in FIG. 1) and a closing position (shown in FIG. 2), in which it opens and closes the receptacle 3, respectively.

Figure 5:
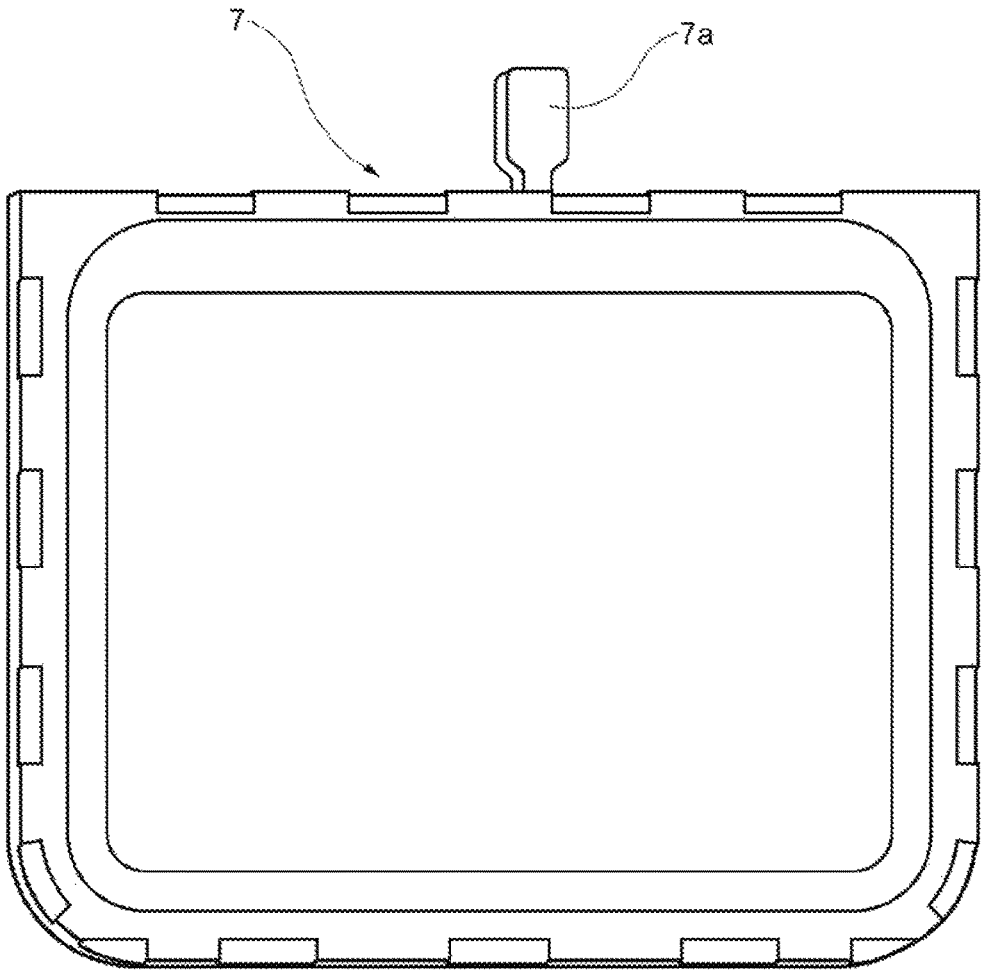
FIG. 5 is a perspective view of a sealing gasket carried by the cover of FIG. 4.

Turning now to FIG. 4, on its internal side, namely on the side facing the casing 2, the cover 5 carries a gasket indicated 7 in FIGS. 4 and 5.

The gasket 7 is made of a soft, elastic material, for instance silicon rubber, and is shaped such as to be able to sealingly close the receptacle 3, by being pressed against the raised peripheral mouth edge 4*a* of said receptacle 3, when the cover 5 is brought to the closing position.

In a per se known manner, a spring or the like is associated with the cover 5, to bias it towards the open position.

The dispenser 1 comprises further a retaining mechanism adapted to maintain the cover 5 in its closing position (FIG. 2), and to disengage therefrom to allow its return to the opening position under the action of the above-mentioned spring.

In the illustrated embodiment said retaining mechanism includes a retaining member 8 (FIGS. 2 and 3) comprising a shaft portion 8*a* and a radially protruding lever portion 8*b*.

Figure 3:
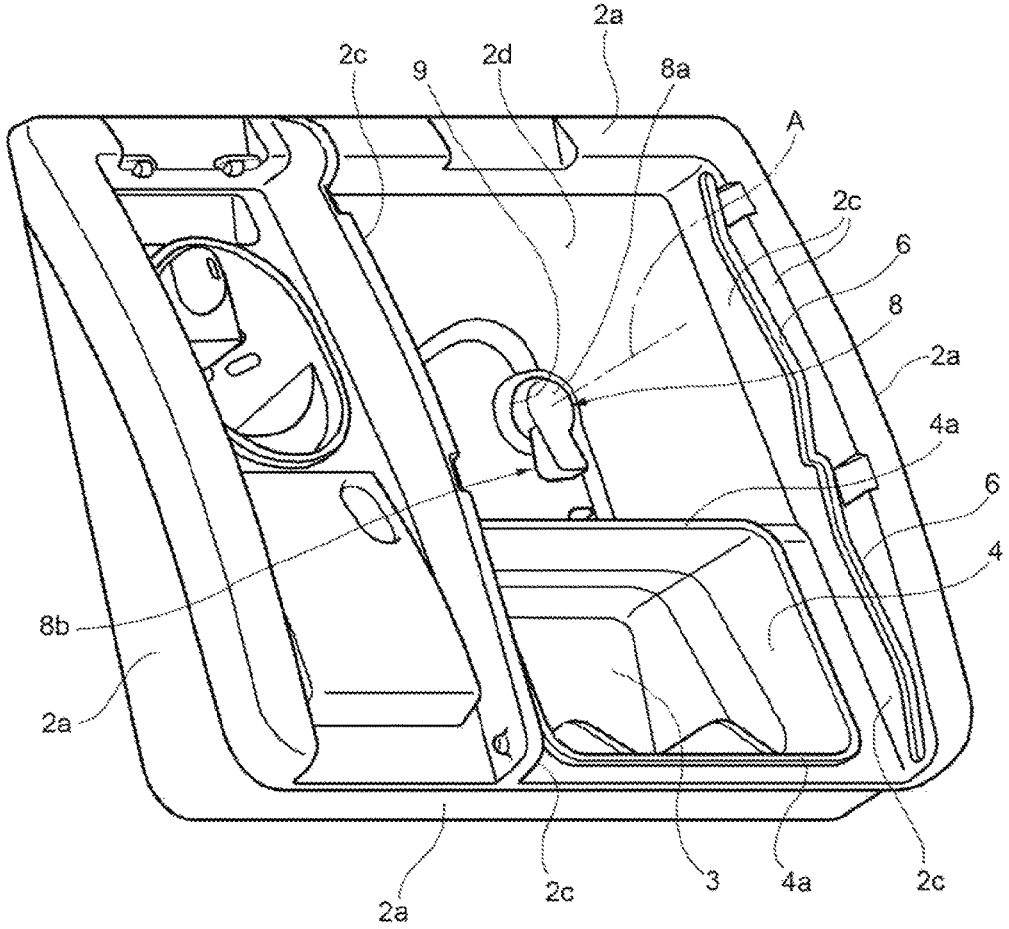
FIG. 3 is a partial perspective view of the dispenser according to the preceding figures, showing in particular the casing thereof.

The shaft portion 8*a* of the retaining member 8 is mounted in an opening 9 provided in a wall portion 2*d* of the casing 2, facing the internal side of the cover 5 (FIGS. 2 and 3). Said shaft portion 8*a* is rotatable about an axis A, which is essentially orthogonal to the wall portion 2*d* of the casing 2. Said shaft portion 8*a* of the retaining member 8 is coupled, in a per se known manner, with an electrically-controlled actuator, such as a solenoid actuator, mounted in the rear portion 2*b* of the casing 2. Through said actuator the retaining member 8 can, in the operation, be rotated between first and second angular positions, in which the lever portion 8*b* thereof is adapted to retain and release, respectively, a hooking member carried by the cover 5, as it will be disclosed hereinafter.

Figure 6:
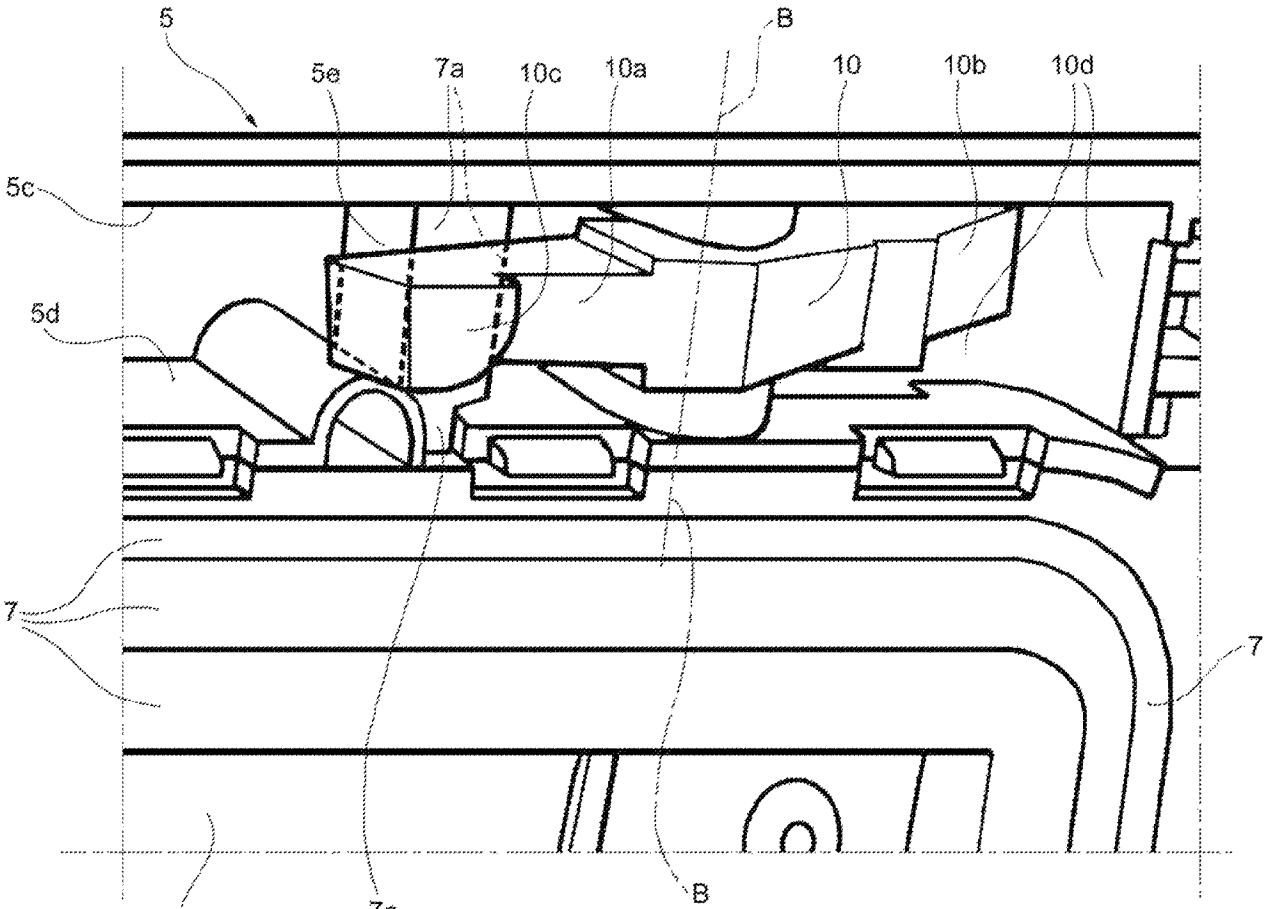
FIG. 6 shows in a larger scale a detail indicated by an arrow VI in FIG. 4.

As shown in FIGS. 4 and 6, on the internal side of the cover 5, above the seat where the gasket 7 is positioned, there is mounted a hooking member 10, adapted to cooperate with the retaining member 8 of the casing 2 as it will be described in the following.

In the illustrated embodiment the hooking member 10 is a rocking lever, mounted oscil-latable about an axis B, between a top edge wall portion 5*c* of the cover 5, and a wall portion 5*d* which concurs to defining the seat for the gasket 7.

The hooking member or lever 10 has two arms 10*a*, 10*b*, extending on opposite sides with respect to the axis B.

The arm 10*a* of said hooking member or lever 10 at its distal end is provided with a projection 10*c* extending towards the wall 2*d* of the casing 2. Said projection 10*c* is intended to cooperate with the lever portion 8*b* of the retaining member 8, as it will be described hereinafter.

The arm 10*b* of hooking member or lever 10 is provided with an integral pushbutton-like formation 10*d*, which extends through an opening 11 provided in the cover 5 (see FIGS. 1 and 2).

With reference to FIG. 5, the gasket 7 of elastic material is provided with an integral appendage 7*a*, which extends towards the outside from the upper side of said gasket 7.

As it can be better seen in FIG. 6, the integral appendage 7*a* of the gasket 7 is interposed between the arm 10*a* of the hooking member or lever 10 and a projection 5*e* provided in the internal surface of the cover 5.

The arrangement is such that when the pushbutton-like portion 10*d* of the hooking member or lever 10 is manually depressed from the outside of the cover 5, said hooking member or lever 10 rotates about the axis B, in a clockwise sense when seen as in FIG. 4, and the other arm 10*a* of said hooking member or lever 10 resiliently compresses the appendage 7*a* of the gasket 7. The latter behaves like a return spring, in that, when the pushbutton-like formation 10*d* is released, said appendage 7*a* elastically re-expands, causing the hooking member 10 to return to its initial position.

In use, when the cover 5 is manually caused to slide from its opening position towards its closing position (while the pushbutton-like formation 10*d* of the hooking member 10 is not subjected to any pressure), said hooking member 10 is able to engage, with its projecting portion 10*c*, beyond the end of the lever portion 8*b* of the retaining member 8 when the cover 5 reaches the closing position. Consequently, the cover 5 is subsequently retained in the closing position.

However, as soon as the retaining member 8 is later on caused to rotate (by the actuator associated therewith, energized in the course of a washing cycle) said retaining member 8 rotates such that the lever portion 8*b* thereof disengages from the end projection 10*c* of the hooking member 10 carried by the cover 5, permitting the cover to return to its opening position, under the action of an associated spring member (not illustrated in the drawings, but known per se).

As soon as the actuator is subsequently de-energized, the retaining member 8 resumes its initial position, in which it is able to engage and retain the cover 5, when the latter is again displaced to its closing position.

The pushbutton-like formation of the hooking member 10 allows to cause the passage of the cover 5 from the closing position to the opening position when the door of the dishwasher is open; this can be easily achieved by simply exerting a pressure on said pushbutton-like formation 10*d* by means of a finger, such as to cause the disengagement of the projecting end portion 10*c* of the hooking member 10 from the retaining member 8.

As already mentioned above, by providing the gasket 7 with an integral appendage 7*a* adapted to behave like a return spring associated with the hooking member 10, it is possi-ble to avoid using a separate helical spring which besides being a supplementary distinct component, could not be easily mounted between the hooking member and the cover, Naturally, without prejudice to the principle of the invention, the forms of implementation and the details of embodiment may vary widely with respect to what has been described and illustrated herein purely by way of a non-limiting example, without getting out of the scope of the invention as defined in the appended claims.

The invention claimed is:

1. A washing agent dispenser for a dishwasher, comprising a casing defining at least a receptacle adapted to receive an amount of washing agent, a cover displaceable relative to the casing between an opening position and a closing position in which it opens and closes said receptacle, respectively; the cover carrying a gasket made of an elastic material, adapted to sealingly close said receptacle in said closing position of the cover; and a retaining mechanism including:

a retaining member movably mounted in the casing, and a hooking member movably mounted in the cover and adapted to cooperate with the retaining member such that when the cover closes the receptacle the hooking member is kept, by an associated resilient member carried by the cover, in a condition of engagement with the retaining member, maintaining the cover in the closing position;

said hooking member being disengageable from the retaining member either manually or by means of an actuator associated with said retaining member;

wherein the resilient member associated with the hooking member carried by the cover comprises an appendage integrally formed with and extending from said elastic sealing gasket, said appendage of the gasket being interposed between the cover and said hooking member.

* * * * *